US006457993B1

(12) United States Patent
Espenshade

(10) Patent No.: US 6,457,993 B1
(45) Date of Patent: Oct. 1, 2002

(54) MODULAR JACK WITH LED

(75) Inventor: Leonard K. Espenshade, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/944,651

(22) Filed: Aug. 31, 2001

(51) Int. Cl.[7] ..... H01R 3/00
(52) U.S. Cl. ..... 439/490; 439/489
(58) Field of Search ..... 439/489, 490, 439/676, 488, 607

(56) References Cited

U.S. PATENT DOCUMENTS 4,978,317 A * 12/1990 Pocrass ..... 439/490
5,704,802 A * 1/1998 Loudermilk ..... 439/490
5,775,946 A * 7/1998 Briones ..... 439/607
5,797,767 A * 8/1998 Schell ..... 439/329

* cited by examiner

*Primary Examiner*—Khiem Nguyen
*Assistant Examiner*—Chandrika Prasad
(74) *Attorney, Agent, or Firm*—Wei Te Chung

(57) ABSTRACT

A modular jack (1) comprises an insulative housing (2), a terminal module (3) received in the housing, and a pair of LEDs (4). The insulative housing comprises a top wall (21), a bottom wall (22) and a pair of side walls (23). The top wall, the bottom wall and the side walls together define a receiving cavity (20) for receiving a complementary plug connector. The bottom wall defines a pair of recesses (221) at a front end thereof adjacent to corresponding side walls and two pairs of slits (223) respectively communicating with corresponding recesses. Each LED is received in one of the recesses of the housing, and comprises an indicator (40) and a pair of leads (41) extending from the indicator. The leads are received in the slits for electrically connecting the indicator with a mating printed circuit board.

10 Claims, 6 Drawing Sheets

MODULAR JACK WITH LED

BACKGROUND OF THE INVENTION

1. Field of the Invention

The present invention relates to a modular jack, and particularly to a modular jack which retains a pair of LEDs (Light-Emitting Diodes) therein.

2. Description of Related Art

A modular jack, also known as an RJ connector, is commonly used in network and computer peripheral equipment system for the transmission of voice and data. An RJ connector is typically used to form a link between two pieces of equipment to provide a communication means between two pieces of equipment. In order to ensure the integrity of the link, it has been a practice in the industry to use a LED located separately from the link to provide visual status and fault information regarding the connection. RJ connectors having such LEDs are disclosed in U.S. Pat. Nos. 4,978,317 and 5,704,802, wherein a LED always is in a "L" shape and comprises a horizontal stabilizer and a vertical retainer both of which are inserted into corresponding recesses defined in the connector. The LEDs are typically assembled in the housing from the rear to the front. However, it is inconvenient and time-consuming to assemble the LED into the housing in this design.

An improved modular jack with secured LEDs is required to overcome the disadvantages of the related art.

SUMMARY OF THE INVENTION

Accordingly, the object of the present invention is to provide a modular jack which has a pair of conveniently to assembled built-in LEDs.

In order to achieve the object set forth, a modular jack for receiving a plug connector comprises an insulative housing, a terminal module and a pair of LEDs. The insulative housing comprises a top wall, a bottom wall and a pair of side walls. The top wall, the bottom wall and the side walls together define a receiving cavity for receiving the terminal module and the plug connector. The bottom wall comprises a pair of recesses in a front end adjacent to corresponding side walls, two pairs of slits respectively communicating with corresponding recesses and a pair of tabs between corresponding pair of slits. The LEDs are received in the recesses of the housing, and each comprises an indicator and a pair of leads extending rearwardly and downwardly from the indicator. The leads are received in the slits for connecting the indicator with a mating printed circuit board.

Other objects, advantages and novel features of the invention will become more apparent from the following detailed description when taken in conjunction with the accompanying drawings.

DETAILED DESCRIPTION OF THE INVENTION

Figure 1:
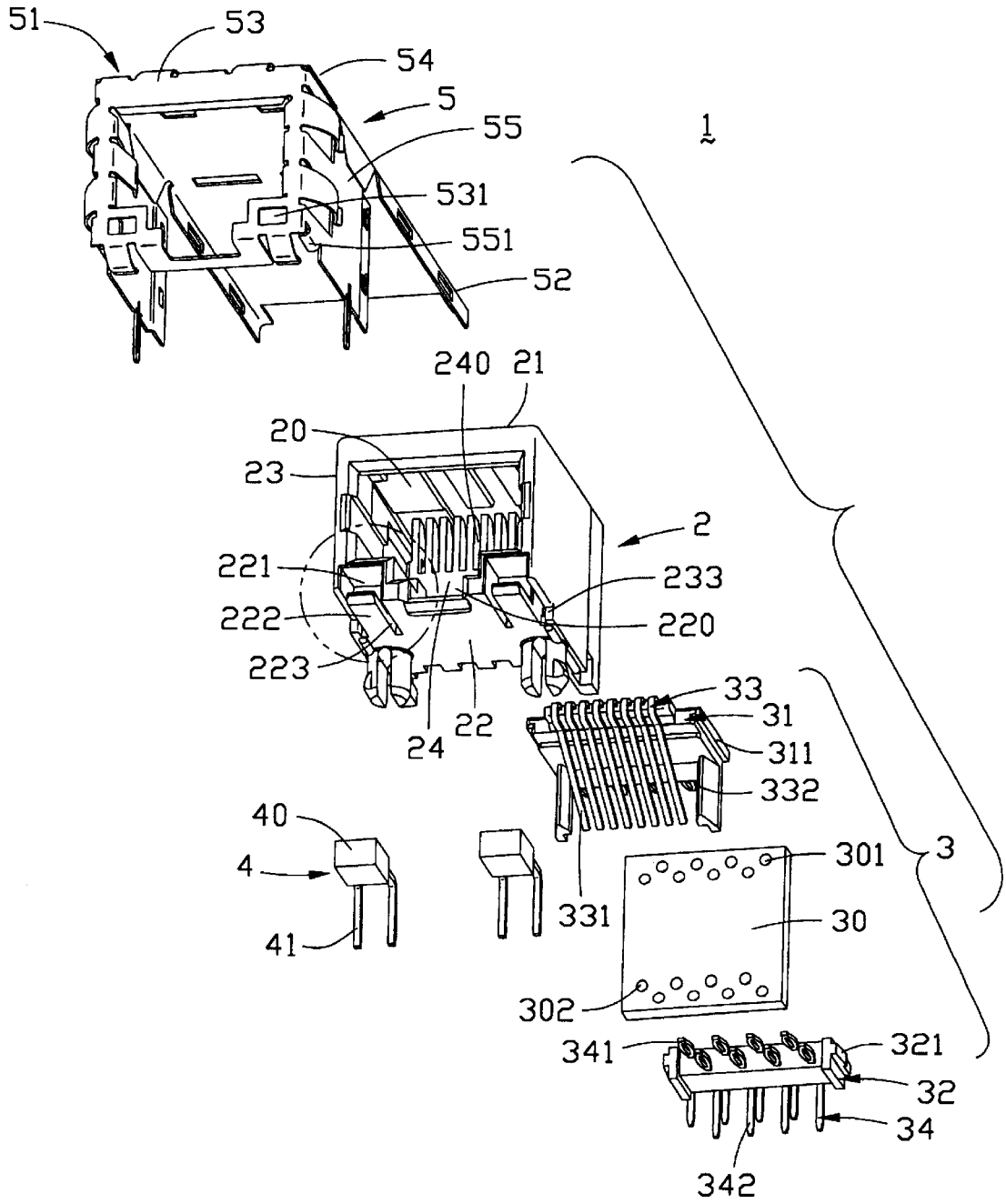
FIG. 1 is an exploded, perspective view of the modular jack with a pair of built-in LEDs in accordance with the present invention.

Reference will now be made to the drawing figures to describe the present invention in detail.

Referring to FIG. 1, a modular jack 1 of the present invention comprises an insulative housing 2, a terminal module 3 secured in the housing 2 for electrically mating with contacts of a mating plug connector (not shown), a pair of LEDs 4 indicating whether an electrical connection is established or not and a shield 5 enclosing the housing 2.

Figure 3:
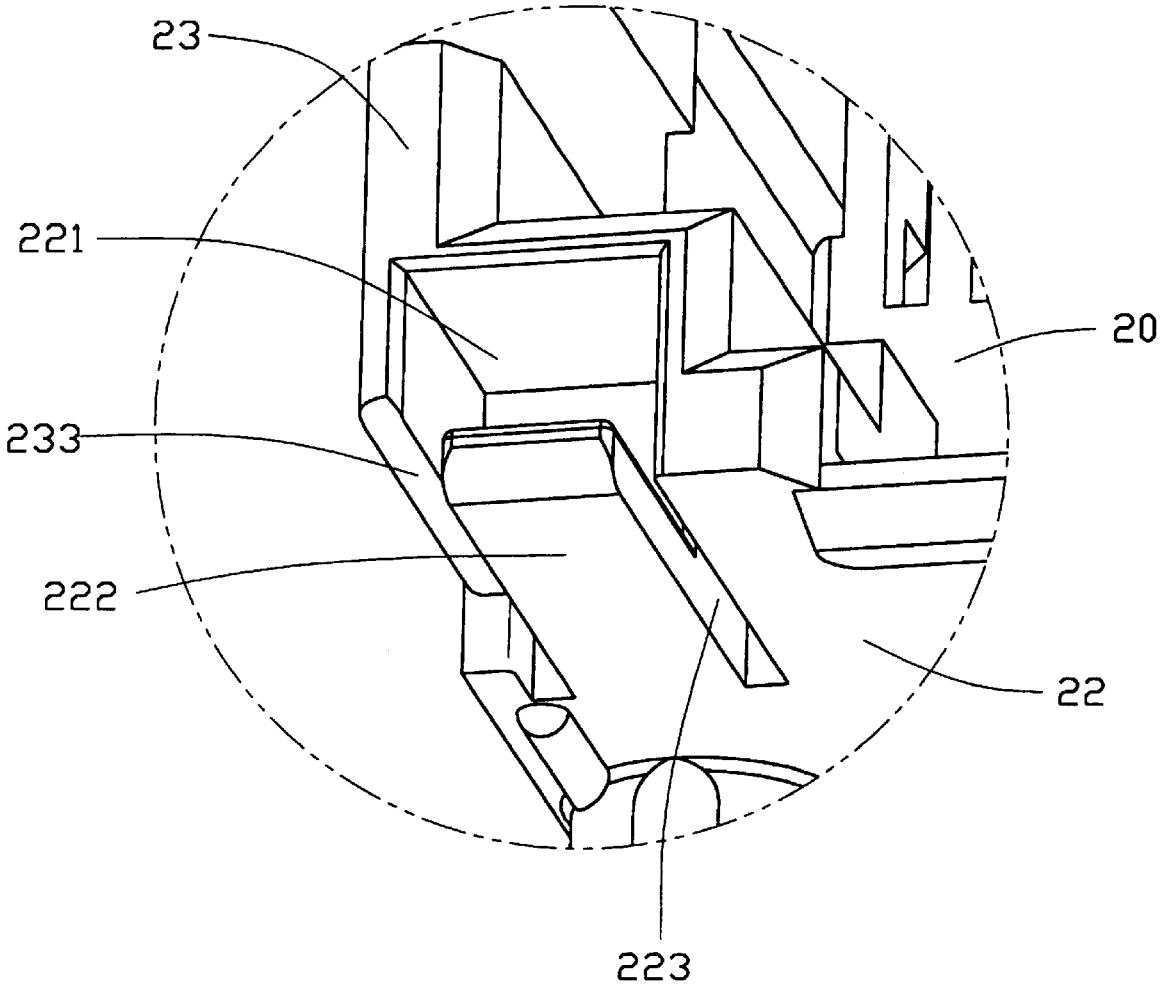
FIG. 3 is an enlarged, perspective view of a circled area, in FIG. 1 showing a receiving groove in a housing of the modular jack.
Figure 4:
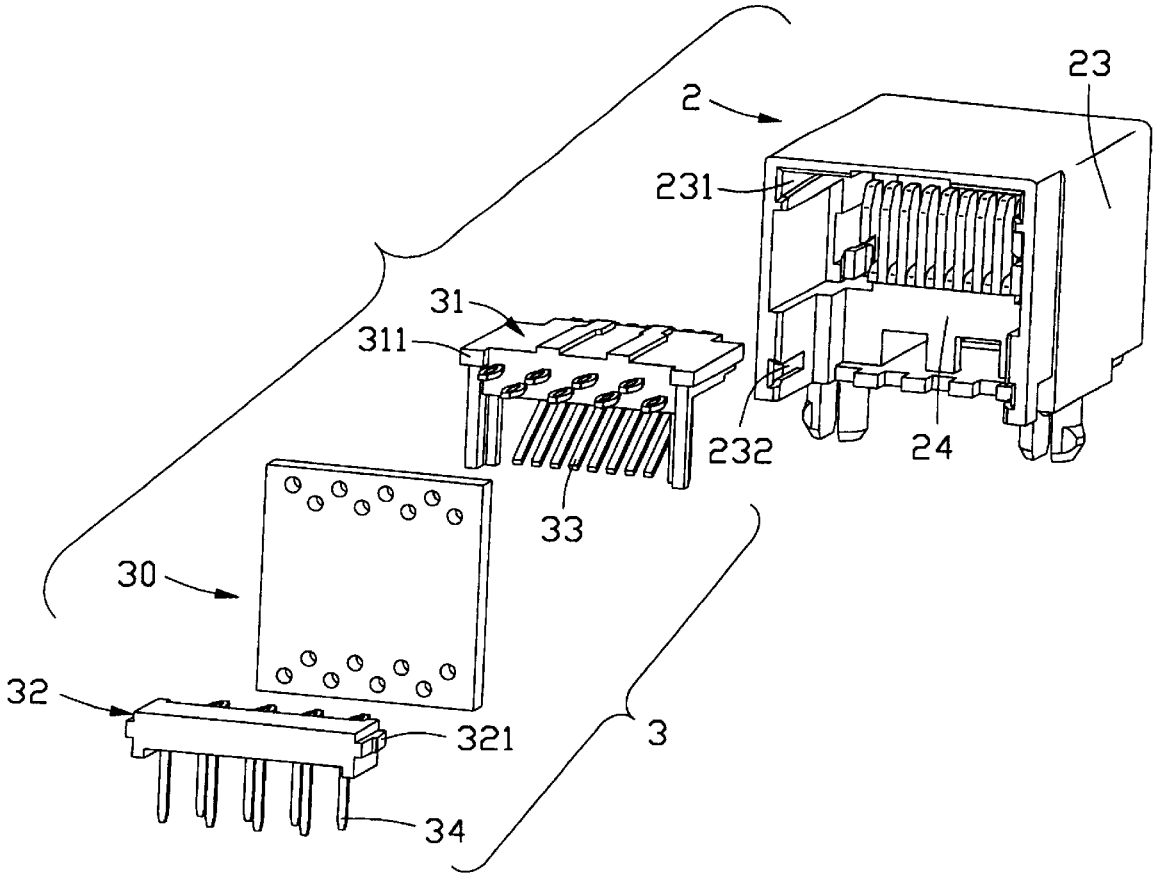
FIG. 4 is a rear, perspective view of the housing and a terminal module in FIG. 1.

Referring to FIGS. 1 and 3–4, the insulative housing 2 includes a top wall 21, a bottom wall 22 and a pair of side walls 23 connecting the top and bottom walls 21, 22. The top wall 21, the bottom wall 22 and the side walls 23 together define a receiving cavity 20 therebetween for receiving the plug connector and the terminal module 3 therein. The insulative housing 2 comprises a block wall 24 upwardly extending from the bottom wall 22 into the receiving cavity 20. The block wall 24 defines a plurality of passageways 240 at an upper end thereof. The bottom wall 22 defines a recess 220 communicating with the receiving cavity 20 for receiving a latch of the complementary plug connector thereinto, a pair of receiving slots 221 at opposite ends thereof for receiving the LEDs 4, two pairs of slits 223 respectively communicating with corresponding receiving slots 221 and a pair of tabs 222 extending forwardly between corresponding pair of slits 222. As is shown in FIG. 4, each sidewall 23 defines a upper recess 231 at a top inner end thereof, a lower recesses 232 at a bottom inner end thereof, and a cut-out 233 at a front and bottom end thereof. Both the upper and lower recesses extend inwardly from a rear edge of the side walls 23.

The terminal module 3 includes a front dielectric base 31, a rear dielectric base 32, a plurality of front terminals 33 retained in the front base 31, a plurality of rear terminals 34 retained in the rear base 32 and a linking PCB (printed circuit board) 30 for electrically connecting the front terminals 33 and the rear terminals 34. The front base 31 comprises a pair of outwardly extending front flanges 311 at opposite transverse ends thereof. Similarly, the rear base 32 comprises a pair of outwardly extending rear flanges 321 at each transverse end thereof. Each front terminal 33 comprises a contacting portion 331 for connecting with the plug connector and a front linking portion 332 mounted on the linking PCB 30. Similarly, each rear terminal 34 comprises a rear linking portion 341 mounted on the linking PCB 30 and a tail portion 342 for mating with a printed circuit board (not shown). The linking PCB 30 defines a plurality of upper holes 301 in an upper end thereof for receiving the front linking portions 331 of the front terminals 33 and a plurality of lower holes 302 in a lower end thereof for receiving the rear linking portions 341 of the rear terminals 34.

Figure 2:
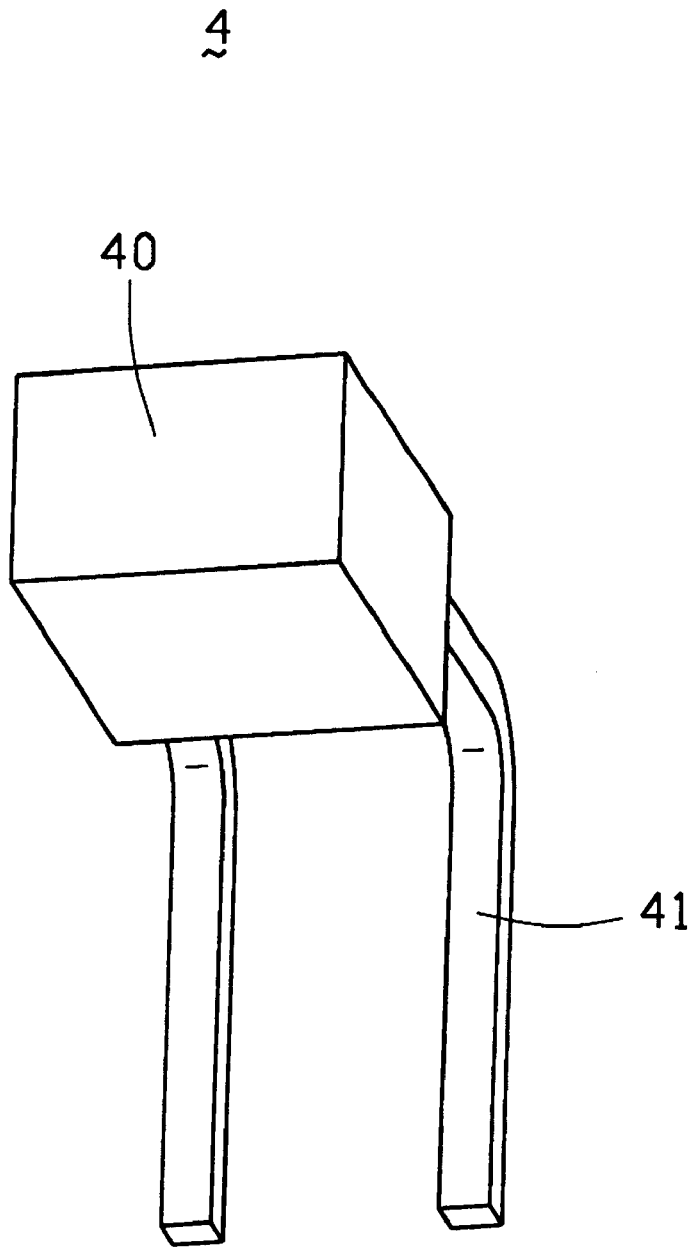
FIG. 2 is an enlarged, perspective view of the LED in FIG. 1.

Referring to FIG. 2, the LED 4 comprises an indicator 40 and a pair of integral conductive leads 41 extending rearwardly and downwardly from a rear edge of the light 40 to electrically connect the indicator 40 with the printed circuit board.

As shown in FIG. 1, the shield 5 comprises a front portion 51 and a rear portion 52. The front portion 51 comprises a front wall 53, a top wall 54 and a pair of side walls 55 connecting with the front and top walls 53, 54. The front wall 53 defines a pair of openings 531 on a bottom end thereof for exposing the indicators 40. Each side wall 55 comprises a bent portion 551 extending inwardly from a bottom edge thereof for engaging with the cut-out 231 of the housing 2 to securely retain the shield 5 on the housing 2. The rear portion 52 extends rearwardly from the top wall 54 of the front portion 51.

In assembly, the front terminals 33 with the front base 31 are mounted on the linking PCB 30 with the front linking portions 332 of the front terminals 33 received in the upper holes 301. Similarly, the rear terminals 34 with the rear base 32 are mounted on the linking PCB 30 with the rear linking portions 341 received in the lower holes 302. Successively, the terminal module 3 is assembled in the receiving cavity 20 from a rear side of the housing 2, whereby the contacting portions 331 of the front terminals 33 are received in corresponding receiving passageways 240. The front flanges 311 of the terminal module 3 are received in the upper recesses 231 of the housing 2. The rear flanges 321 of the terminal module 3 are received in the lower recesses 232 of the housing 2. The LEDs 4 are inserted into the receiving slot 221 from a front side of the housing 2 supported by the tabs 222, and with the leads 41 respectively received in the slits 223 and connecting with the printed circuit board. Finally, the housing 2 is enclosed in the shield 5 for grounding with the bent portions 551 of the side walls 23 engaging with the cut-outs 233 and the rear portion 52 bent downwardly to engage with the front portion 51 thereby enclosing the housing 2 securely. The openings 531 expose the indicators 40, such is convenient for observation of the users.

Figure 5:
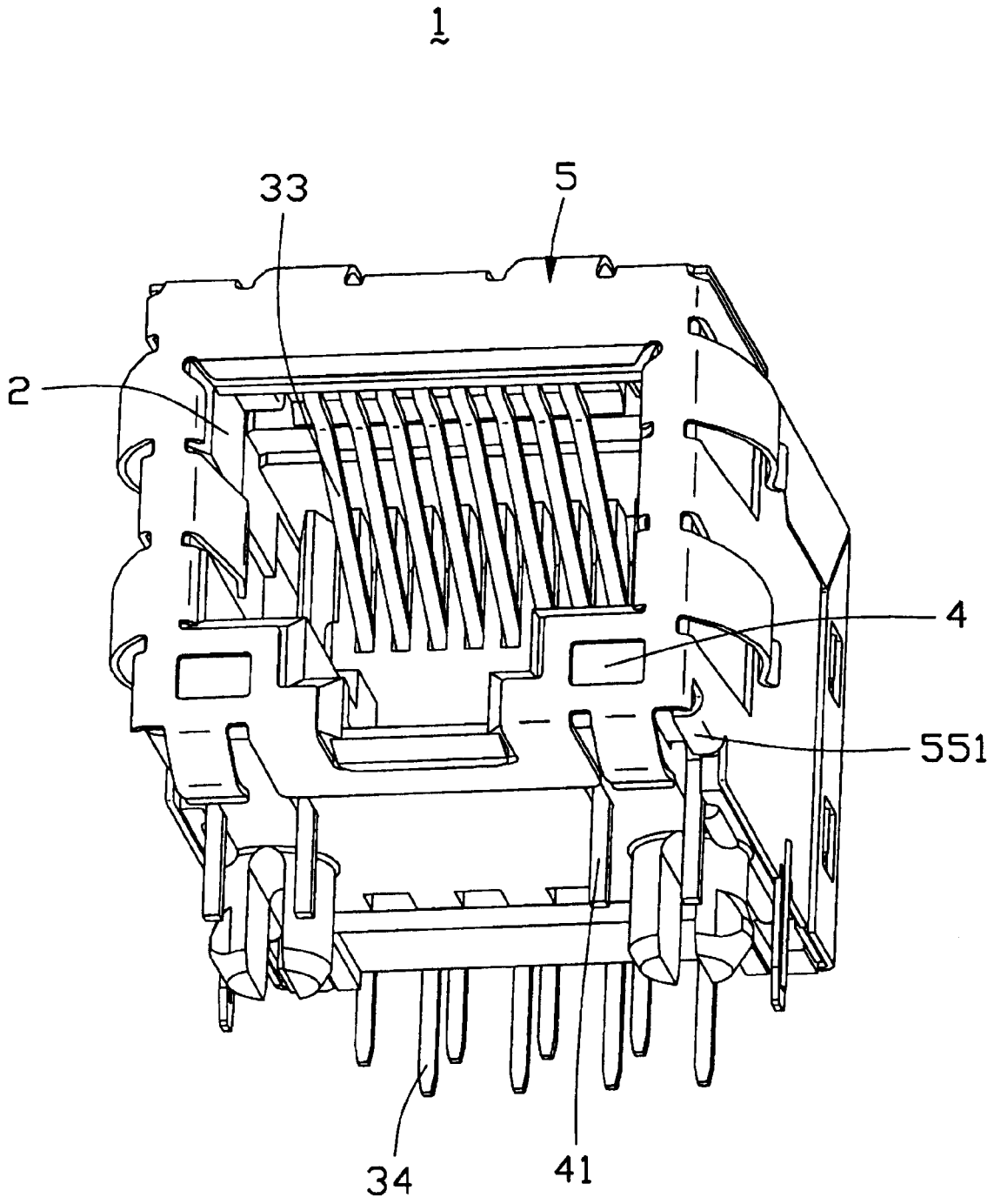
FIG. 5 is an assembled view of the modular jack in FIG. 1.

As the receiving slots 221 are defined at the front edge of the bottom wall 22, it is convenient for insertion of the LEDs 4 into the receiving slots 221. The shield 5 encloses the housing 2 and prevents the LEDs 4 from being pulled off from the receiving slots 221. Therefore, the LEDs 4 are securely retained in the receiving slots 221 as shown in FIG. 5.

Figure 6:
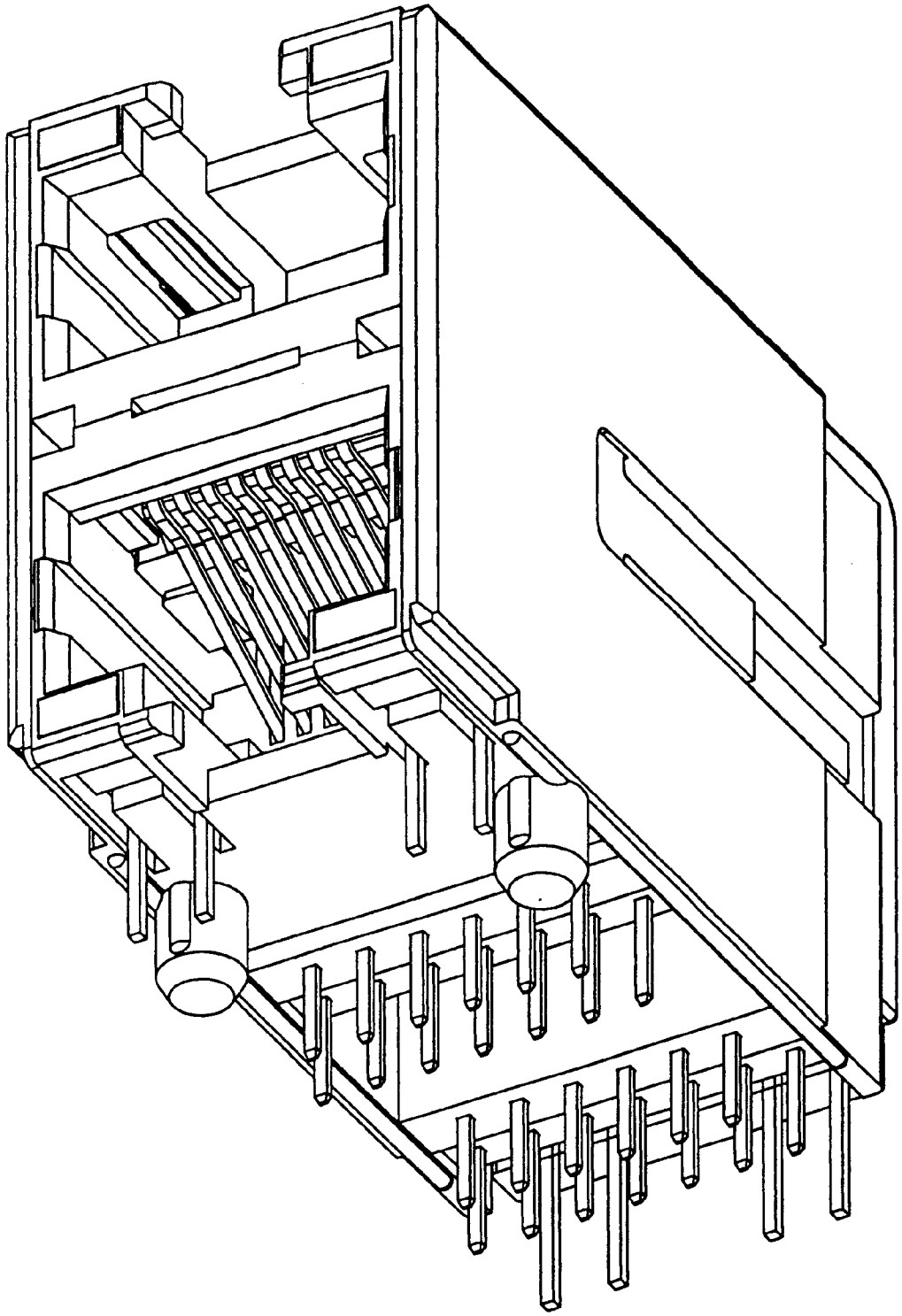
FIG. 6 is another embodiment of the invention.

FIG. 6 shows another embodiment wherein a rectangular frame formed on the front face in front of the tab for firmly holding the indicator 40 in position. Under this situation, installation of the LED should be first in a tilted position to have the leads enter the slot through the front opening of the rectangular frame and later downwardly moved to extend through the slit and successively move the LED rearwardly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack for receiving a plug connector, comprising:

an insulative housing comprising a top wall, a bottom wall, and a pair of side walls, the top wall, the bottom wall and the side walls together defining a receiving cavity for receiving the plug connector, the bottom wall defining a pair of slots at a front end thereof and a pair of tabs extending forwardly under the slots;

a terminal module received in the receiving cavity; and a pair of LEDs (Light-Emitting Diodes) each comprising an indicator received in the slot and supported by the tab.

2. The modular jack as described in claim 1, wherein the bottom wall defines two pairs of slits communicating with corresponding slots, and each LED comprises a pair of leads extending from the indicator and received in corresponding pair of slits.

3. The modular jack as described in claim 1, wherein the terminal module comprises a front base, a plurality of front terminals mounted in the front base, a rear base, a plurality of rear terminals mounted in the rear base, and a linking PCB electrically connecting the front and rear terminals.

4. The modular jack as described in claim 1, further comprising a shield enclosing the housing, the shield defining a pair of openings at a bottom end thereof to expose the indicators.

5. The modular jack as described in claim 1, wherein each side wall comprises a cut-out on a bottom thereof, and the shield comprises a pair of bent portions engaged with the cut-outs.

6. A modular jack comprising:

an insulative housing including opposite top and bottom walls, and a pair of opposite side walls, all together defining a receiving cavity in communication with an exterior in a front-to-back direction;

a plurality of terminals disposed in said cavity;

a pair of receiving slots extending into the housing around two opposite corners of the housing below said cavity and substantially communicating with the exterior in said front-to-back direction;

a pair of parallel slits formed in the bottom wall under said cavity and forming a supporting tab therebetween;

a pair of LEDs respectively received within the corresponding slots, each of said LEDs including an indicator and a pair of conductive leads on a rear portion thereof; wherein in each of said LEDs, said indicator defines a bottom face supportably seated upon the corresponding tab and a rear face from which the pair of leads extend and further downwardly through the corresponding slits.

7. The modular jack as described in claim 6, wherein each of said slots has a cubic configured and the indicator has the same to mate with.

8. The modular jack as described in claim 6, wherein a shield encloses the housing with portions engaging the indicators for preventing withdrawal of the LEDs from the corresponding slots, while also forming openings therein for exposing the corresponding indicators thereabouts.

9. The modular jack as described in claim 6, wherein said tab is of a cantilever type.

10. A modular jack comprising:

an insulative housing including opposite top and bottom walls, and a pair of opposite side walls, all together defining a receiving cavity in communication with an exterior in a front-to-back direction;

a plurality of terminals disposed in said cavity;

a pair of receiving slots extending into the housing around two opposite corners of the housing below said cavity and substantially communicating with the exterior in said front-to-back direction;

a pair of parallel slits formed in the bottom wall under said cavity with a rectangular frame on a front face of the housing;

a pair of LEDs respectively received within the corresponding slots, each of said LEDs including an indicator and a pair of conductive leads on a rear portion thereof; wherein in each of said LEDs, said indicator defines a bottom face supportably retained in the rectangular frame, and a rear face from which the pair of leads extend and further downwardly through the corresponding slits.

* * * * *